US006619090B2

(12) United States Patent
Heffe

(10) Patent No.: US 6,619,090 B2
(45) Date of Patent: Sep. 16, 2003

(54) ROLL-HARDENING MACHINE FOR CRANKSHAFTS

(75) Inventor: Roland Heffe, Korschenbroich (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 22 days.

(21) Appl. No.: 10/005,894

(22) Filed: Dec. 4, 2001

(65) Prior Publication Data

US 2002/0073756 A1 Jun. 20, 2002

(30) Foreign Application Priority Data

Dec. 4, 2000 (DE) ..... 100 60 218

(51) Int. Cl.[7] ..... B21D 15/00

(52) U.S. Cl. ..... 72/110; 72/10.4; 72/465.1; 72/481.6; 29/6.01

(58) Field of Search ..... 72/10.4, 14.4, 72/107, 110, 465.1, 481.1, 481.6; 29/6.01, 888.08

(56) References Cited

U.S. PATENT DOCUMENTS 4,559,798 A * 12/1985 Hayashi et al. ..... 72/110
5,943,893 A * 8/1999 Goedderz et al. ..... 72/110
6,393,886 B1 * 5/2002 Bagusche ..... 72/110

FOREIGN PATENT DOCUMENTS

EP 0 881 041 A2 12/1998

* cited by examiner

*Primary Examiner*—Ed Tolan
(74) *Attorney, Agent, or Firm*—Garlsoh, Gaskey & Olds

(57) ABSTRACT

A roll-hardening machine for crankshafts with hard-rolling tools (2) which each have a hard-rolling roller head (1) and a counter-support roller that are each detachably attached to the ends (17) of appropriate scissors arms (3) by means of two clamping blocks (15) wherein respectively a first of the two clamping blocks (15) is positioned on the front surface (16) of the end (17) of the scissor arm (3) and the second clamping block is located at a right angle to the first (15) on the side surface (16) of this same scissor arm (3) on the tool side, characterized in that the first clamping block (15) is supported on the front surface (16) at the end (17) of the respective scissors arm (3) such that it can slide in the direction of the appropriate hard-rolling tool (1), the hard-rolling roller head (1) is supported moveably at the location of the second clamping block on the scissors arm (3), by having guide grooves on its front surfaces facing the scissors arm (3), wherein prismatic blocks of the scissors arm (3) engage and the second clamping block for the counter-support roller head is supported such that it can move elastically in the clamping direction at its scissors arm.

28 Claims, 7 Drawing Sheets

ROLL-HARDENING MACHINE FOR CRANKSHAFTS

RELATED APPLICATIONS

This patent application claims priority to German Patent Application No. 100 60 218.5-14 filed Dec. 4, 2000.

BACKGROUND OF THE INVENTION

The invention relates to a roll-hardening machine for crankshafts with hard-rolling tools which each have a hard-rolling roller head and a counter-support roller head that are each detachably attached to the ends of appropriate scissors arms by means of two clamping blocks wherein respectively a first of the two clamping blocks is positioned on the front surface of the end of the scissor arm and the second clamping block is located at a right angle to the first on the side surface of this same scissor arm on the tool side.

A roll-hardening machine for crankshafts of this type is known, for example, from EP 0 881 041 A2 by the same applicants. In particular the attachment of the hard-rolling tool is shown in FIGS. 2*a*, 2*b*, 2*c* and 3 of this European Patent Application. A single hard-rolling tool consists of a hard-rolling roller head, denoted by 66 in the European Patent Application, and a counter-support roller head, denoted by 74 in said Application. A hard-rolling head 66 and counter-support roller head 74 forming the hard-rolling tool are respectively attached to the ends 65 and 73 of the appropriate scissors arms 46 and 47. No details of the attachment are specified in the Application, although the aforementioned figures show clamping blocks by means of which the hard-rolling head 66 and the counter-support roller head 74 are respectively attached from two sides to a scissors arm 46 or 47 by screws. These are detachable fastenings which are accomplished by means of screwed joints since both the hard-rolling head 66 and the counter-support roller head 74 must be exchanged from one case to another. In order to replace the hard-rolling tool, the screwed joints of the relevant clamping blocks must be loosened before the hard-rolling roller head or the counter-support roller head can be removed. When clamping the hard-rolling tools, the screwed joints must be tightened again every time.

The loosening and re-tightening of the screwed joints is time-consuming, regardless of the fact that the hard-rolling tools are not always easily accessible in the hard-rolling machine. Changing the known hard-rolling tools accordingly lengthens the setting periods of the hard-rolling machine.

From said disadvantages it is the object of the present invention to substantially reduce the setting periods of the hard-rolling machine. At the same time, the hard-rolling tools should be attached to the hard-rolling machine in such a way that the hard-rolling force can be measured and the state of the hard-rolling rollers can be determined.

SUMMARY OF THE INVENTION AND ADVANTAGES

The first clamping block is supported on the front surface at the end of the respective scissors arm such that it can slide in the direction of the appropriate hard-rolling tool; the hard-rolling roller head is supported and moveably received by the second clamping block on the scissors arm, by having guide grooves on its front surfaces facing the scissors arm, in which prismatic blocks of the scissors arm engage; and the second clamping block for the counter-support roller head is supported such that it can move elastically in the clamping direction at its scissors arm.

This type of moveable attachment of the hard-rolling tools to the hard-rolling machine has a multitude of advantages. By incorporating grooves on the front surfaces of the hard-rolling roller head and counter-support roller head facing the scissors arms these two hard-rolling tools can be moveably supported in the hard-rolling machine. At the same time they can also be clamped and unclamped in a simple fashion in that the clamping blocks with which the hard-rolling tools are respectively attached at the end of the appropriate scissors arm are supported slidably in the direction of the hard-rolling tool. For the counter-support roller head the first clamping block is, for example, engaged and disengaged by means of an eccentric lever and for the hard-rolling roller head the first clamping block is automatically held in the locking position by means of a compression spring. Said first clamping block can then be moved out therefrom by means of a simple hand tool so that the hard-rolling roller head can be unclamped from the machine.

In addition to the clamping and unclamping of the hard-rolling tools in the hard-rolling machine being simplified, the movable bearing of the hard-rolling tools inside the machine also allows forces and states important for the problem-free operation of the hard-rolling machine to be determined. Thus, for example, it is possible to bring the hard-rolling roller head on the front surface facing the hard-rolling rollers in contact with piezoelectric sensors by means of which the appropriate hard-rolling force can be measured exactly. On the basis of these measured values it is then possible to regulate the hard-rolling force so that the crankshaft remains straight during hard rolling and thereafter exhibits no eccentricity. With the aid of another sensor which engages in one of the front surfaces of the hard-rolling roller head it is even possible to determine the state of the hard-rolling rollers. Here use is made of the fact that the guide roller which is placed inside the hard-rolling roller head and serves to guide the hard-rolling rollers, runs true irregularly when these are worn or ruptured. The regularity of the true running of the guide roller can be determined using projections or recesses at the edge of the guide roller in connection with the sensor which is constructed as a proximity switch. Irregularities here indicate wear or rupture of the hard-rolling rollers.

In order to avoid changing the hard-rolling tools for different crankshafts, there are provided index pins which engage from the hard-rolling roller head or counter-support roller head into holes located in the adjacent front surfaces of the scissors arms. This indexing ensures that in each case, only the hard-rolling tool provided for the appropriate type of crankshaft is installed in the hard-rolling machine.

The moveable support of the counter-support roller head has the advantage that the support rollers can conform to the respectively crankshaft bearings being hard-rolled with a high degree of uniformity.

Finally there are provided tool-changing tongs which can be attached one after the other on the hard-rolling roller head as well as on the counter-support roller head in order to change the appropriate hard-rolling tool can easily and without any risk to the machine tool setter. For using the tool-changing tongs, projections are provided in each case on the accessible front surfaces of the hard-rolling roller head and counter-support roller head to which the tool changing tongs can attach.

BRIEF DESCRIPTION OF THE DRAWINGS

The invention will now be described in greater detail with reference of an embodiment example. The drawings are in each case side views on a reduced scale where.

DETAILED DESCRIPTION OF THE PREFERRED EMBODIMENT

Figure 1:
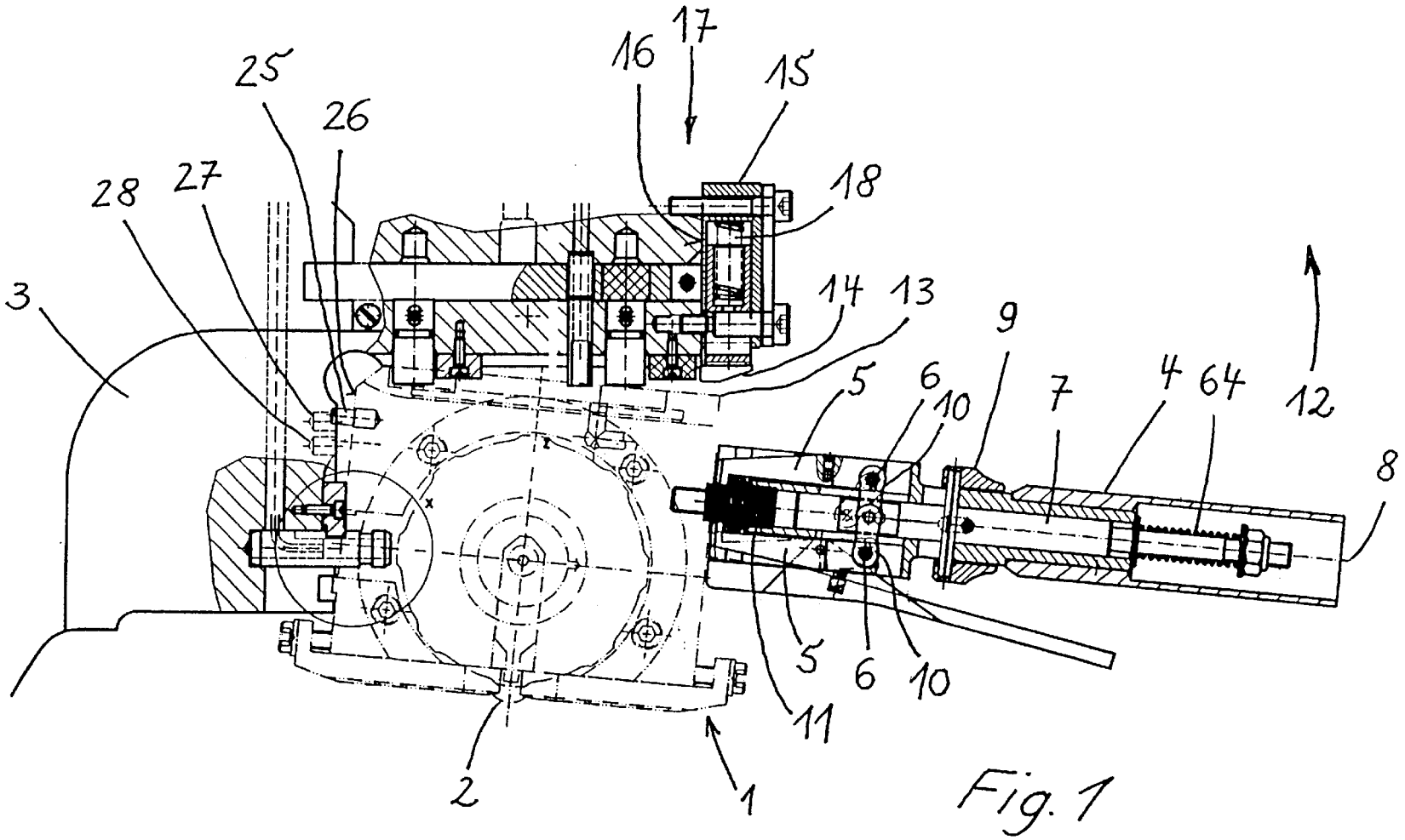
FIGS. 1 and 2 show the clamping of a hard-rolling roller head.

A hard-rolling head 1 which has hard-rolling rollers 2 for rolling a crankshaft (not shown) is clamped in the scissors arms 3 of an inherently known hard-rolling machine. For this purpose the hard-rolling roller head 1 is grasped by tool-changing tongs 4 and inserted into the scissors arm 3. The tool-changing tongs 4 have two tong-like grippers 5 which are respectively pivoted about pivot points 6. Spreading out and closing the grippers 5 is accomplished via a guide rod 7 which is arranged slidably along the longitudinal axis 8 of the tool-changing tongs 4. The sliding of the guide rod 7 is accomplished by means of a collar 9 which can be slid backwards and forwards in the direction of the longitudinal axis 8 by hand. In order to transfer the axial movement of the guide rod 7 to the grippers 5 there are provided joints 10 which convert the axial movement of the guide rod 7 into spreading-out or closing movements of the grippers 5. For example, when the collar 9 moves in the direction of the hard-rolling roller head 1, the grippers 5 are spread out. When the guide rod 7 slides in the opposite direction under the action of a return spring 64, the grippers 5 are closed and thereby grip behind a knob 11 which protrudes from the hard-rolling roller head 1 and is rigidly connected thereto.

Figure 2:
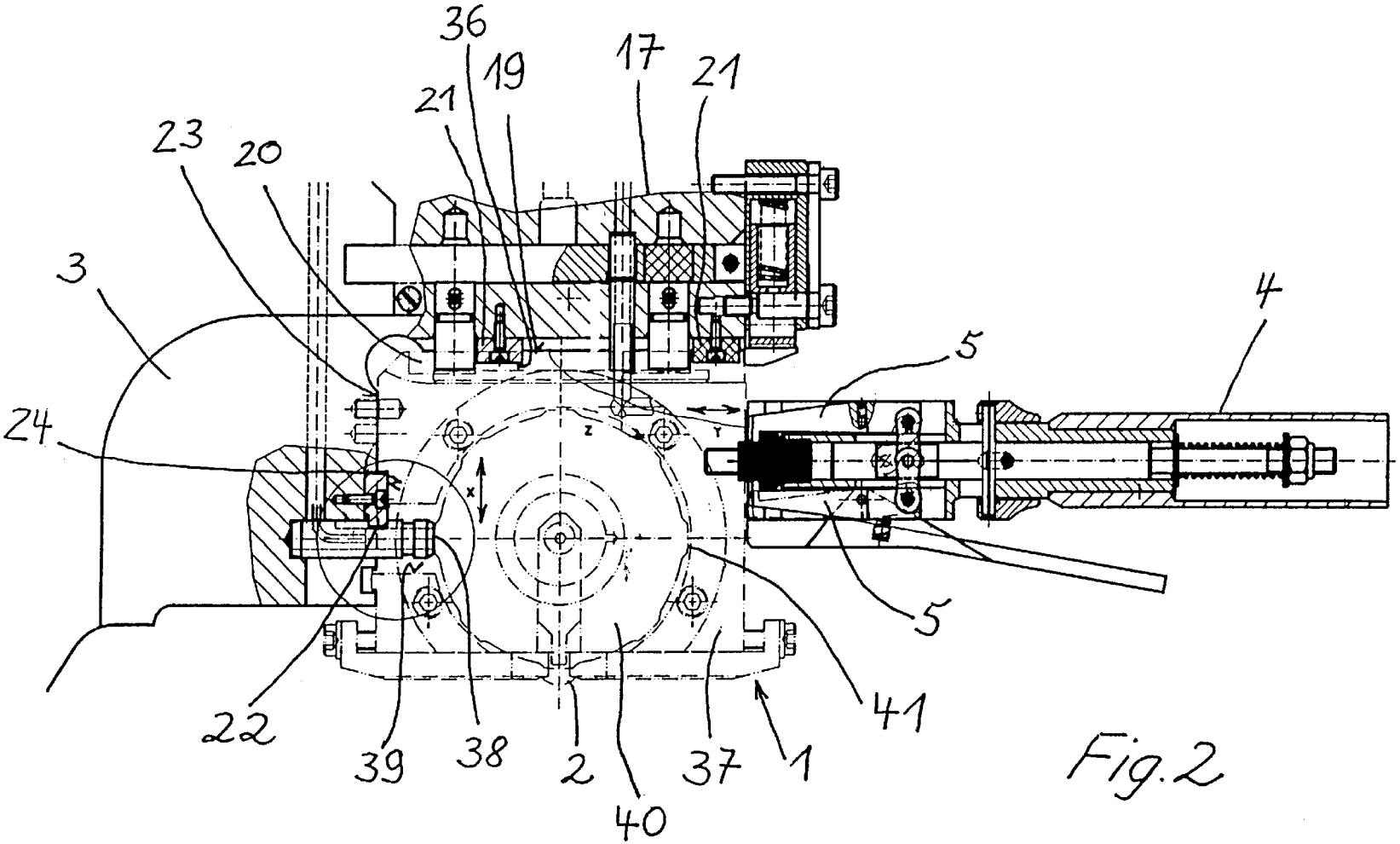

In FIG. 1 the hard-rolling roller head 1 is inserted from below into the scissors arm 3 and is connected to the scissors arm 3 by means of an upward tilting movement in the direction of the arrow 12. Hereby the upper edge 13 of the hard-rolling roller head 1 initially overlies the downward-projecting nose 14 of a first clamping block 15. The first clamping block 15 is supported on the front surface 16 at the end 17 of the scissors arm 3 slidably in the direction of the hard-rolling roller head 1. The first clamping block 15 is held continuously in its locking position by a spring 18. By means of the upward movement in the direction 12 the resistance of the spring 18 is overcome and the upper edge 13 of the hard-rolling roller head 1 disappears behind the nose 14 of the first clamping block 15, as can be seen in FIG. 2. In this closed position the tool-changing tongs 4 are then immediately released from the hard-rolling roller head 1 by spreading out the grippers 5.

On the front face 19 of the hard-rolling roller head 1 facing the scissors arm 3 a longitudinal groove 20 is incorporated as a guide groove (FIG. 2). Into this longitudinal groove 20 engage prismatic blocks 21 from the end 17 of the scissors arm 3 and ensure that the hard-rolling head is guided in the x and y directions. Further guidance in the two x and y guide directions is provided by a groove block 22 which projects from the recessed front surface 23 of the scissors arm 3 and engages in a groove 24 of the hard-rolling roller head 1. In the groove 24 the hard-rolling roller head 1 is also guided by the groove block 22 in the z-direction which extends normally to the viewing planes of FIGS. 1 to 4.

When the hard-rolling roller head 1 is inserted in the hard-rolling machine as shown in FIG. 1, index pins 25 which project from the rear face 26 of the hard-rolling roller head 1 engage in holes 27 provided in the front face 23 of the scissors arm 3. The indexing via the pins 25 and holes 27 ensures that in each case only the hard-rolling roller head 1 suited to a specific type of crankshaft can be inserted in the hard-rolling machine. A second hole 28 next to the hole 27 indicates the indexing possibility.

Figure 3:
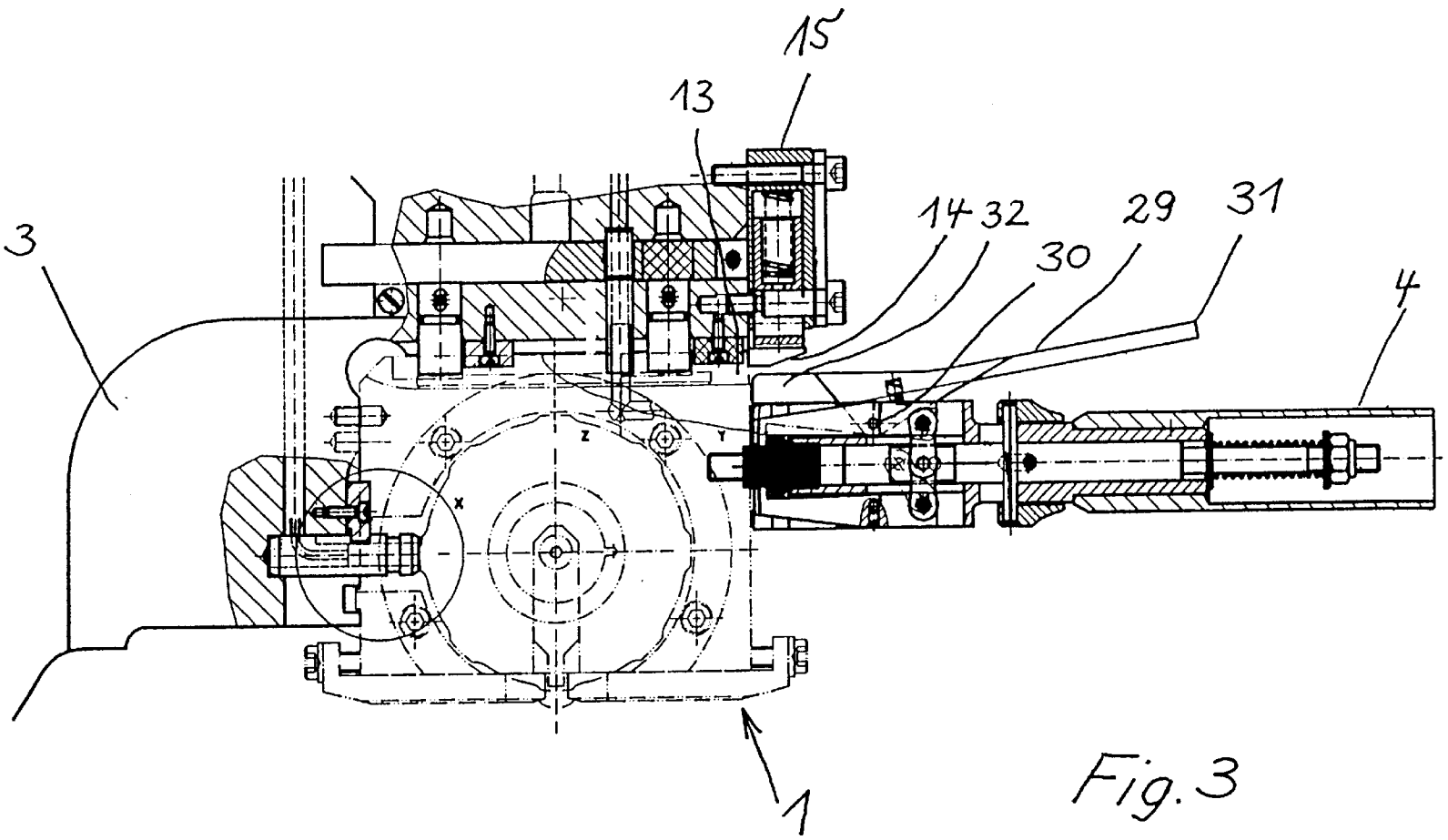
FIGS. 3 and 4 show the unclamping of a hard-rolling roller head.
Figure 4:
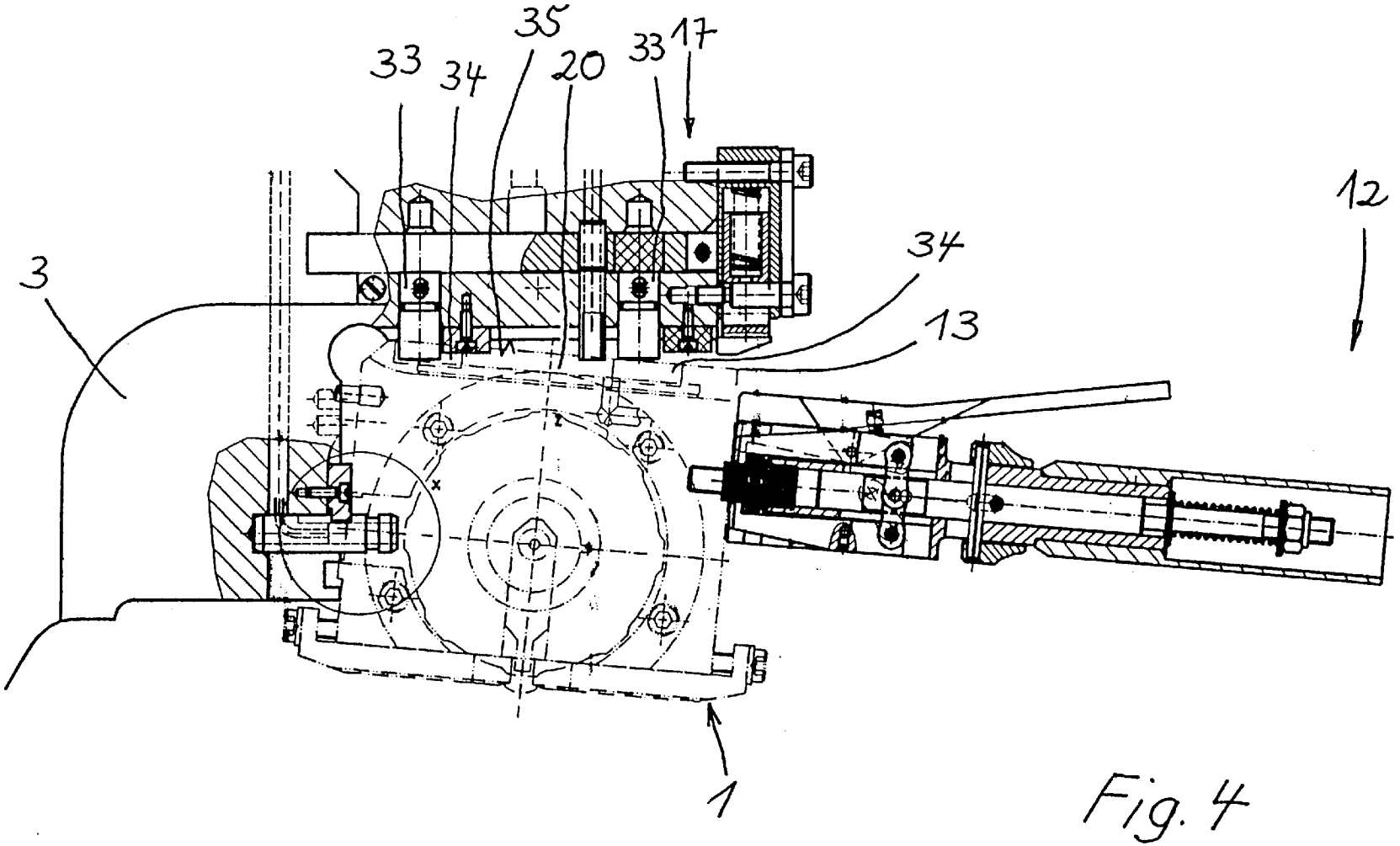

The tool-changing tongs 4 also have a tilting lever 29 which is pivoted at a point 30 on the tool-changing tongs 4. By pressing down the rear end 31 of the tilting lever 29, its front end 32 is spread away from the tool-changing tongs 4 (FIG. 3). Thereby the front end 32 impacts on the nose 14 of the first clamping block 15 and moves this upwards. The upper edge 13 of the hard-rolling roller head 1 is thus free and this can be tilted away downwards in the direction of the arrow 12 and unclamped from the hard-rolling machine (FIGS. 3 and 4).

From the end 17 of the scissors arm 3 extending in the direction of the hard-rolling roller head 1 two piezoelectric sensors 33 engage in recesses 34 incorporated on the upper front surface 35 along the longitudinal groove 20 in the hard-rolling roller head 1. As can be seen from FIGS. 2 and 3, the two piezoelectric sensors 33 are located above the recesses 34 each in close contact with the hard-rolling roller head 1. Between the base of the longitudinal groove 20 and the groove blocks 21 there is in each case a limited clearance 36 and there is also just such a clearance between the groove 24 and the groove block 22. As a result of the clearance 36 the hard-rolling roller head 1 has restricted movement in the vertical direction x. However this mobility is sufficient to transfer the hard-rolling forces at the hard-rolling rollers 2 via the casing 37 of the hard-rolling roller head 1 to the piezoelectric sensors 33.

From the front face 23 another sensor 38 projects from the scissors arm 3 and protrudes into a recess 39 in the casing 37 of the hard-rolling roller head 1. The sensor 38 is a proximity switch. To actuate this, there are provided, distributed over a circumference of the guide roller 40 which supports the hard-rolling rollers 2 in the hard-rolling roller head 1, projections 41 which move past the sensor 38 as the guide roller 40 revolves. As can be seen from FIGS. 1 to 4, the projections 41 are provided at regular intervals around the circumference of the guide roller 40. As a result of wear or a possible rupture of the hard roller 2, the revolution of the guide roller 40 becomes irregular. This irregularity is recorded by the sensor 38 and is reported as a fault to the machine control of the hard-rolling machine.

Figure 5:
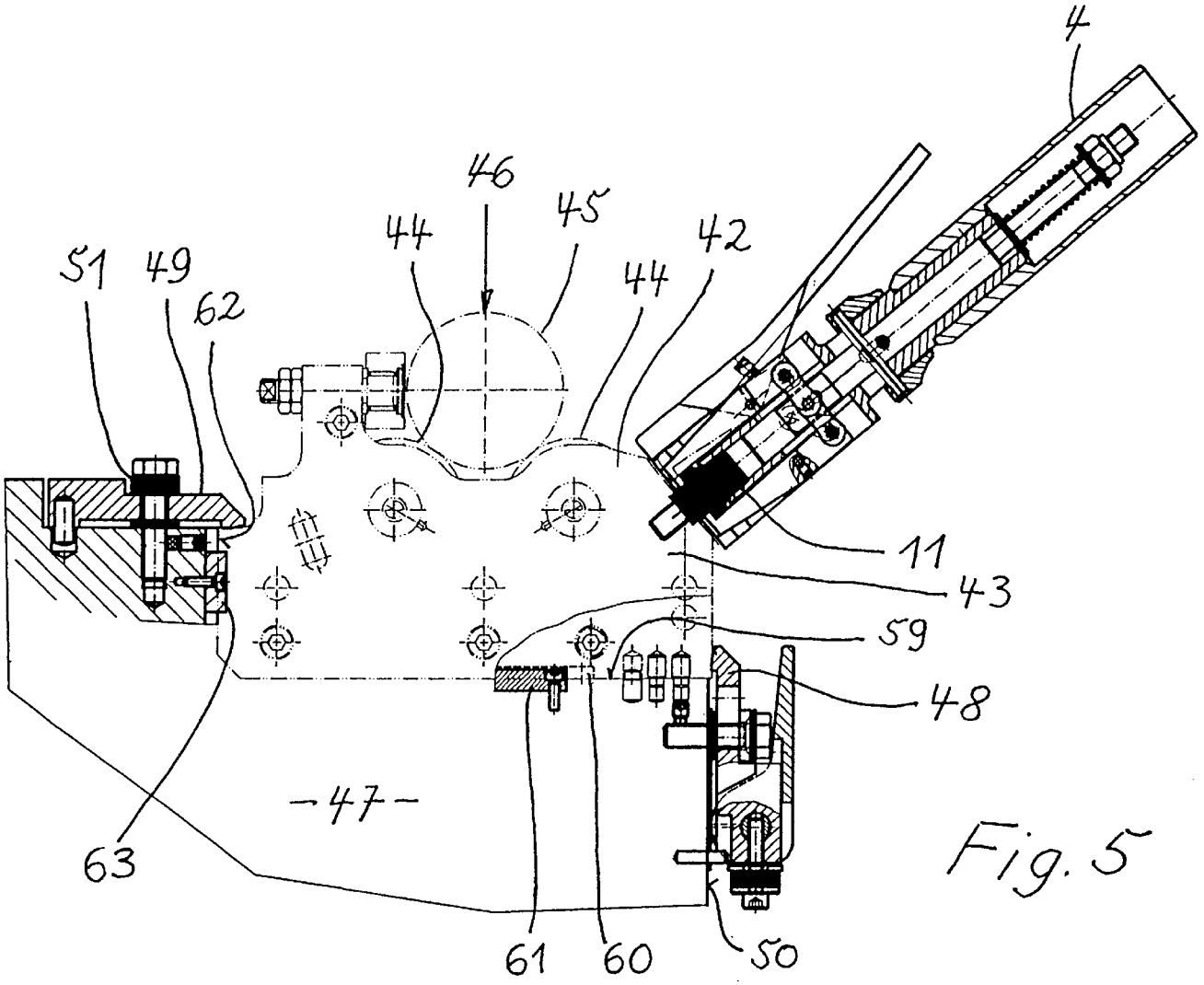
FIG. 5 is a counter-support roller head clamped and locked in the hard-rolling machine.
Figure 6:
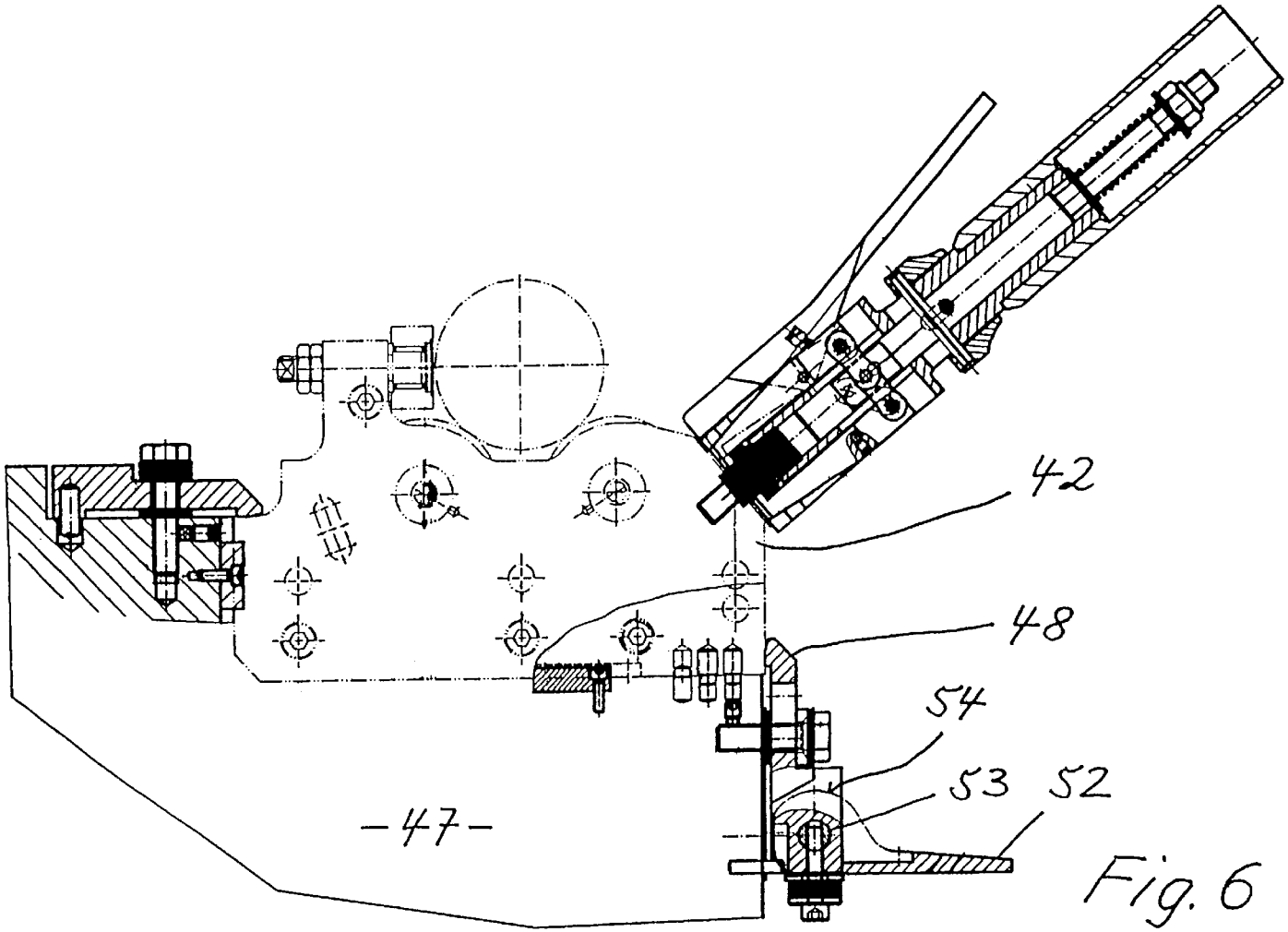
FIG. 6 shows the unlocking of the counter-support roller head.
Figure 7:
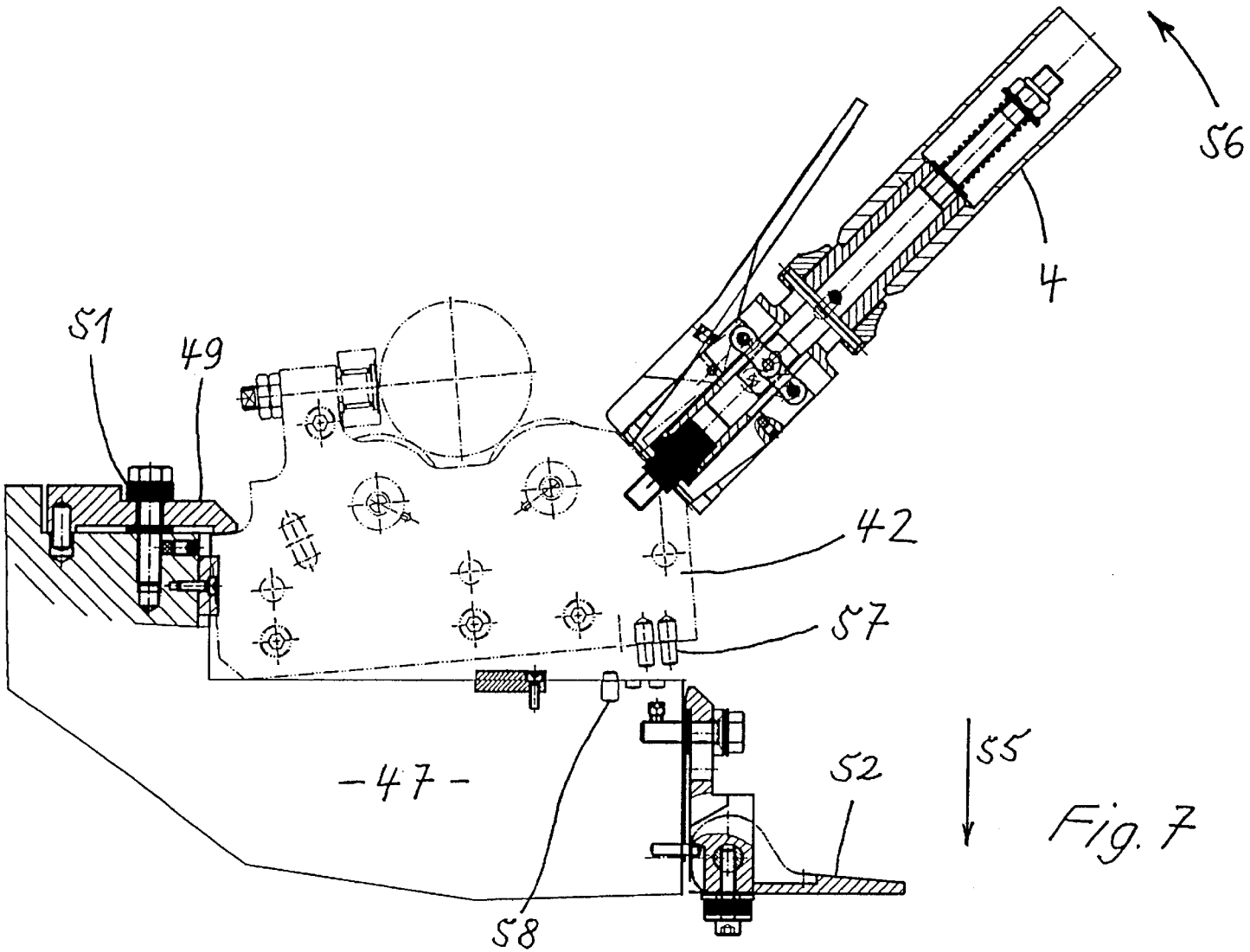
FIG. 7 shows the unclamping of an unlocked counter-support roller head from the hard-rolling machine.

The tool-changing tongs 4 are configured such that they can also be used to change a counter-support roller head 42 (FIGS. 5 to 7). For this purpose the tool-changing tongs 4 again act on a knob 11 which is provided on the casing 43 of the counter-support roller head 42. The knob 11 on the counter-support roller head 42 is constructed in exactly the same way as the knob 11 on the hard-rolling roller head 1. The dashed lines respectively indicate the two counter-support rollers 44 which support a crankshaft (not shown) on main bearing pin 45. In each case there are provided two counter-support rollers 44 which support the crankshaft against the hard-rolling force 46.

The casing 43 of the counter-support roller head 42 is held on the scissors arm 47 with the aid of two clamping blocks 48 and 49. Whereas the first clamping block 48 is arranged slidably on the front face 50 of the scissors arm 47, the second clamping block 49 is attached elastically to the scissors arm 47 via springs 51.

The first clamping block 48 is actuated by tilting a tilting lever 52. The tilting lever 52 is pivoted on an axis 53 and has an eccentric contour 54 through which the locking position (FIG. 5) and the unlocking position (FIGS. 6 and 7) are defined. The first clamping block 48 is unlocked by tilting the tilting lever 52 into the position shown in FIG. 6 whereupon the counter-support roller head 42 is released by further sliding of the tilting lever 52 in the direction 55 by hand. The counter-support roller head 42 unlocked as shown in FIG. 6 can then be unclamped from the hard-rolling machine by tilting the tool-changing tongs 4 upwards in the direction 56, as shown in FIG. 7. When the counter-support roller head 42 is tilted in the direction 56, the second clamping block 49 is raised elastically by pressing together the set of springs 51.

For the counter-support roller head 42 index pins 57 which engage in holes 58 in the scissors arm 47 also provide indexing of the counter-support roller head 42 inside the hard-rolling machine. The counter-support roller head 42 is floatingly supported on the scissors arm 47. For this purpose on its lower side 59 facing the scissors arm 47 there is incorporated a longitudinal groove 60 wherein a groove block 61 projecting from the scissors arm, 47 engages. A comparable guide is achieved on the adjacent face 62 where a second groove block 63 projecting from the scissors arm 47 engages in the casing 43 of the counter-support roller head 42. A counter-support roller head 42 is clamped into the hard-rolling machine in the reverse sequence to the procedures selected and described in FIGS. 5 to 7.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A roll-hardening machine for crankshafts comprising:

scissor arms having opposing ends;

hard rolling tools including a hard-rolling roller head and a counter-support roller with the hard-rolling roller head detachably attached to one of the ends and the counter-support roller attached to the other end;

two clamping blocks wherein respectively a first of the two clamping blocks is positioned on a front surface of each end of the scissors and a second clamping block is located at a right angle to the first clamping block on a side surface of one of the ends on a tool side;

the first clamping block is supported on the front surface at the end of the respective scissors arm such that it can slide in the direction of the appropriate hard-rolling tool;

the hard-rolling roller head is supported and moveably received by the second clamping block on the scissors arm, by having guide grooves on its front surfaces facing the scissors arm, in which prismatic blocks of the scissors arm engage; and the second clamping block for the counter-support roller head is supported such that it can move elastically in the clamping direction at its scissors arm.

2. A hard-rolling machine according to claim 1, characterized in that guide grooves are provided on the hard-rolling roller head on both front surfaces of the hard-rolling roller head facing the scissors arm, which enclose an angle one with the other, the guide groove on the front side of the hard-rolling roller head facing the hard-rolling roller being constructed as a longitudinal groove.

3. A hard-rolling machine according to claim 2, wherein a second groove is provided approximately in the longitudinal centre of the relevant front surface of the hard-rolling head.

4. A hard-rolling machine according to claim 1, wherein at the end of the first clamping block for the counter-support roller head there is provided a tilting lever for sliding the first clamping block into or out of the locking position.

5. A hard-rolling machine according to claim 1, wherein the first clamping block for the hard-rolling roller head can be brought independently into the locking position via a spring.

6. A hard-rolling machine according to claim 5, wherein at the hard-rolling roller head there can e attached a unit which has a tilting lever via which the first clamping block can be unlocked by hand.

7. A hard-rolling machine according to claim 6, wherein the unit comprises tool-changing to tongs.

8. A hard-rolling machine according to claim 7, wherein the tool-changing tongs can be attached alternately at the hard-rolling roller head or at the counter-support roller head.

9. A hard-rolling machine according to claim 1, wherein the counter-support roller head is supported moveably on the scissors arm.

10. A hard-rolling machine according to claim 9, wherein the counter-support roller head has guide grooves on its front surfaces facing the scissors arm, wherein prismatic blocks of he scissors arm engage.

11. A hard-rolling machine according to claim 10, wherein said guide grooves are provided on the counter-support roller head on both front surfaces of the counter-support roller head Facing the scissors arm, which enclose an angle one with the other, the guide groove on the front side of the counter-support roller head facing the counter-support roller being constructed as a longitudinal groove.

12. A hard-rolling machine according to claim 11, wherein a second groove is provided approximately in the longitudinal centre of the relevant front surface of the counter-support roller head.

13. A hard-rolling machine according to claim 1, wherein on the hard-rolling roller head and/or the counter-support roller head of the hard-rolling tool there are provided index pins to engage in the appropriate index holes in the scissors arm.

14. A hard-rolling machine according to claim 1, wherein at least on the scissors arm carrying the hard-rolling roller head there are provided pressure measuring devices to measure the hard-rolling force, which after clamping on the hard-rolling roller head are in contact with at least one of its front surfaces facing the scissors arm.

15. A hard-rolling machine according to claim 14, wherein the pressure-measuring devices are piezoelectric sensors which engage in a recess of the appropriate front surface of the hard-rolling roller head.

16. A hard-rolling machine according to claim 14, wherein the pressure-measuring devices are provided on the front side of the hard-rolling roller head facing the hard-rolling roller.

17. A hard-rolling machine according to claim 1, wherein sensors to determine the wear or any rupture of the hard-rolling roller are provided at least on the hard-rolling roller head.

18. A hard-rolling machine according to claim 17, wherein the sensor to determine the state of the hard-rolling roller is constructed as a proximity switch, which projects from a front surface of the scissors arm and engages in a recess of the appropriate front surface of the hard-rolling roller head and is in operative connection with projections provided on the guide roller with which the hard-rolling rollers in the hard-rolling roller head are guided.

19. A hard-rolling machine for crankshafts comprising:

a scissor arm having an end;

a rolling head having two transverse surfaces adjacent to said end of said scissor arm;

a first complementary interlocking feature locating one of said transverse surfaces and a second complementary interlocking feature locating the other of said transverse surfaces; and a clamping block supported on said scissor arm end movable between clamped and unclamped positions retaining said rolling head in said scissor arm end in said clamped position.

20. The machine according to claim 19, wherein at least one of said complementary interlocking features includes a groove and block.

21. The machine according to claim 19, wherein at least one of said complementary interlocking features includes a pin and hole.

22. The machine according to claim 19, wherein said clamping block includes a nose and a spring biasing said nose toward said clamped position.

23. The machine according to claim 22, wherein said clamping block is transverse to one of said transverse surfaces.

24. The machine according to claim 23, wherein said nose is moveable in a direction generally toward the rolling head.

25. The machine according to claim 19, wherein a cammed handle coacts with said clamping block to move said clamping block between said clamped and unclamped positions.

26. The machine according to claim 25, wherein said clamping block is transverse to one of said transverse surfaces.

27. The machine according to claim 26, wherein said nose is moveable in a direction generally toward the rolling head.

28. The machine according to claim 25, wherein a second block is secured to said scissor arm end by a fastener with a spring arranged between said fastener and biasing said second block toward said end of said scissor arm.

* * * * *

UNITED STATES PATENT AND TRADEMARK OFFICE

CERTIFICATE OF CORRECTION

PATENT NO. : 6,619,090 B2
DATED : September 16, 2003
INVENTOR(S) : Roland Heffe

It is certified that error appears in the above-identified patent and that said Letters Patent is hereby corrected as shown below:

Column 5,
Line 45, insert -- arm -- after “scissors”

Column 6,
Line 14, “e”should be -- be --
Line 18, should read as follows: -- the unit comprises tool-changing tongs. --

Signed and Sealed this

Twenty-third Day of December, 2003

JAMES E. ROGAN
*Director of the United States Patent and Trademark Office*